United States Patent [19]

Cieslak

[11] 4,280,555

[45] Jul. 28, 1981

[54] HEAT EXCHANGER FOR EXHAUST OUTLET OF A ROOM HEATING UNIT

[76] Inventor: Leo Cieslak, 1263 Church, NE., Salem, Oreg. 97301

[21] Appl. No.: 51,404

[22] Filed: Jun. 25, 1979

[51] Int. Cl.[3] ..... F24H 9/02; F24B 7/00

[52] U.S. Cl. ..... 165/47; 165/129; 165/DIG. 2; 165/DIG. 5; 237/55

[58] Field of Search ..... 165/DIG. 2, DIG. 5, 165/DIG. 12, 47, 128, 129; 237/55, 54; 126/99 A, 248

[56] References Cited

U.S. PATENT DOCUMENTS

| | | | |
|---|---|---|---|
| 1,537,016 | 5/1925 | Kroyer | 165/129 |
| 1,965,102 | 7/1934 | Jerome | 126/248 |
| 2,374,185 | 4/1945 | Kleen | 165/DIG. 5 |
| 2,468,909 | 5/1949 | Yeager et al. | 165/DIG. 2 |
| 2,962,218 | 11/1960 | Dibert | 237/55 |
| 3,813,039 | 5/1974 | Wells | 237/55 |
| 3,944,136 | 3/1976 | Huie | 237/55 |
| 4,044,950 | 8/1977 | Engeling et al. | 237/55 |
| 4,103,735 | 8/1978 | Warner | 165/39 |

*Primary Examiner*—Albert W. Davis
*Assistant Examiner*—Margaret A. Focarino
*Attorney, Agent, or Firm*—Klarquist, Sparkman, Campbell, Leigh, Whinston & Dellett

[57] ABSTRACT

The specification discloses a heat exchanger adapted to be coupled between the exhaust outlet of a room heating unit and a chimney for extracting heat from the exhaust gases flowing therethrough and returning the same to the room. The heat exchanger includes a plurality of vertically spaced rows of horizontally extending exhaust conveying tubes. End caps couple adjacent ends of the tubes to form an upwardly progressing serpentine path for the exhaust gases. A shroud structure separately houses individual vertically spaced clusters of the tubes so that air flows by convection generally horizontally past the tubes. Heat exchange efficiency is improved since a fan is not utilized and since the higher tubes do not come into contact with air already heated by the lower tubes.

13 Claims, 6 Drawing Figures

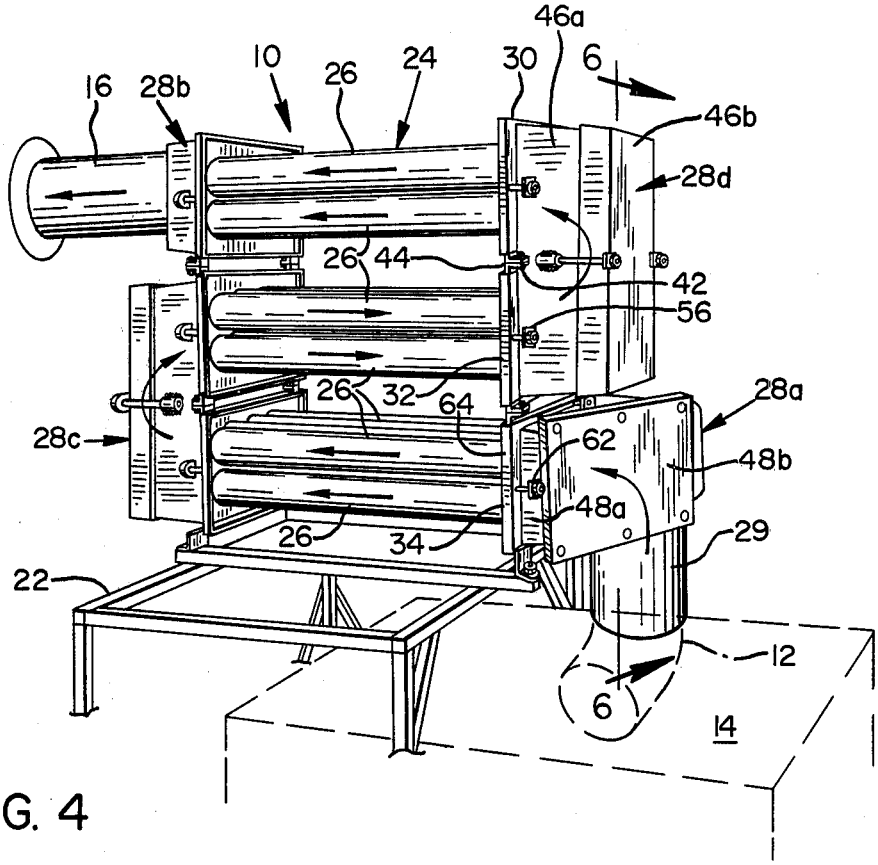
FIG. 4
FIG. 5
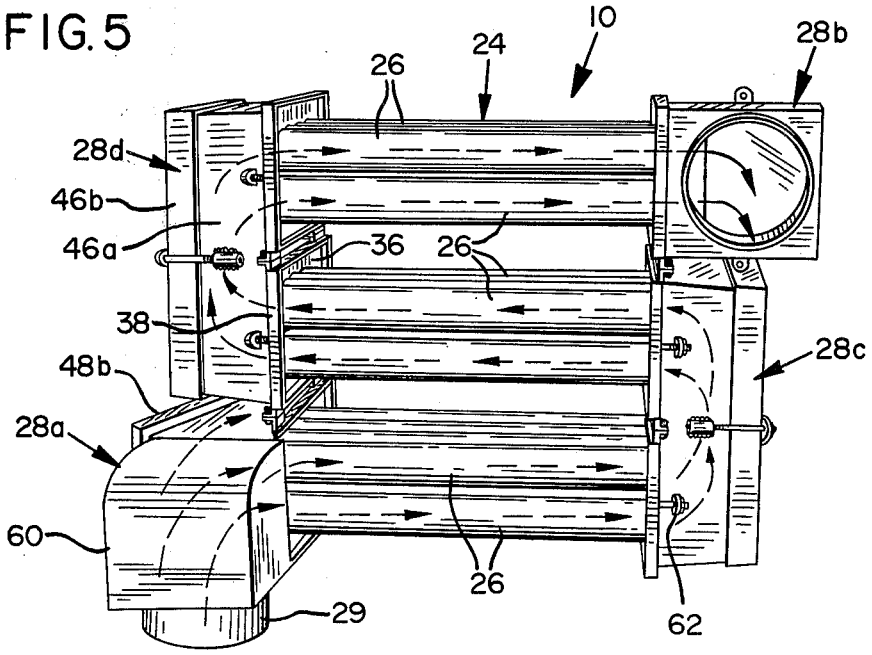

HEAT EXCHANGER FOR EXHAUST OUTLET OF A ROOM HEATING UNIT

BACKGROUND OF THE INVENTION

The present invention relates to heat exchangers, and more particularly to a heat exchanger adapted to be coupled between the exhaust outlet of a room heating unit and a chimney for extracting heat from the exhaust gases flowing therethrough and returning the same to the room.

It is well known that room heating units, such as stoves, furnaces, and the like, lose a large proportion of their generated heat through their chimneys. Numerous heat exchanger devices have been invented in the past for extracting heat from the exhaust gases flowing out of a room heating unit so that the same can be returned to the room thereby resulting in substantial energy savings.

U.S. Pat. No. 2,468,909 shows in FIG. 2 a heat exchanger 10 mounted on the flue gas pipe 11 of an oil burning furnace 12. A fan 20 blows air around the flue pipe 11 and into a conveying pipe 29. U.S. Pat. No. 2,962,218 shows in FIG. 1 a heat exchanger 32 which encircles the flue sections 27 and 28 of a gas furnace 10. A blower 15 draws fresh air through a pipe 46 into the heat exchanger 32 and out of the heat exchanger through a pipe 50.

U.S. Pat. No. 3,944,136 shows in FIGS. 1, 2 and 3 a heat exchanger 32 adapted to extract heat from the stack flue sections 12 and 14 of a conventional gas furnace. The flue gases flow through a plurality of pipes 36 in the heat exchanger 32. Ambient air from the furnace room is drawn by a fan 44 around the pipes 36. U.S. Pat. No. 4,044,950 shows in FIG. 1 a heat exchanger 37 connected intermediate flue pipe sections 21. The heat exchanger 37 has baffles 43 defining a helical air passage about a centrally disposed flue extension pipe 39. Air is blown through the heat exchanger by a blower 57.

U.S. Pat. No. 3,813,039 shows in FIGS. 1 and 2 a heat exchanger which draws hot exhaust gases from a furnace exhaust pipe 10 through a plurality of rows of vertically extending tubes 24, 31 and 35. Adjacent ends of the tubes are coupled to form a serpentine path and exhaust gases from the heat exchanger are re-introduced into the output section 12 of the furnace exhaust pipe. A blower 45 forces air past the tubes 24, 31 and 35 in a serpentine path as indicated in FIG. 2.

U.S. Pat. No. 4,103,735 shows in FIG. 1 a heat exchanger 1 adapted to be utilized in conjunction with the exhaust duct 2 of a furnace F. The furnace exhaust is channelled from the exhaust duct 2 through a plurality of horizontally extending vertically spaced pairs of tubes 4 and out of the exchanger through a chimney duct 10. As shown in FIG. 2, a fan 9 draws air into a housing 22 surrounding the tubes 4 and circulates the air lengthwise about the tubes. The heated air exits through an exhaust duct 7 in the housing 22. The heat exchanger 1 has replaceable end caps 8 and 8' which can be removed to permit cleaning of the heat exchanger.

The following U.S. Pat. Nos. relate to heat exchangers and other apparatus in this field, however, none appears to be any more pertinent to the present invention than the patents discussed above: 931,565; 1,565,032; 1,953,302; 2,190,410; 2,244,055; 2,252,784; 2,267,905; 2,290,255; 2,348,569; 2,362,940; 2,378,181; 2,508,131; 2,527,937; 2,555,842; 2,674,240; 2,711,683; 2,715,018; 2,738,785; 2,764,391; 2,893,374; 3,106,241; and 3,124,197.

While the six patented heat exchangers summarized above improve the energy efficiency of a room heating unit to some extent, each utilizes a fan or blower which itself requires energy to operate. They have not been designed to circulate air by convection. Furthermore, in those patented heat exchangers in which the hot exhaust gases are conveyed through a plurality of tubes, the same air is generally circulated past the entire set of tubes. Thus, some of the heated tubes come into contact with relatively cool room air while others come into contact with air which has been preheated by other tubes past which the air has already circulated. Greater heat exchange efficiency can be achieved if air at or near room temperature is circulated past a larger proportion of the tubes.

SUMMARY OF THE INVENTION

Among the objects and advantages of the present invention are to provide:

a heat exchanger adapted to be coupled between the exhaust outlet of a room heating unit and a chimney for more efficiently extracting heat from the exhaust gases flowing therethrough and returning the same to the room;

a heat exchanger of the aforementioned type which operates without a fan and instead circulates air therethrough by convection;

a heat exchanger of the aforementioned type which includes a plurality of vertically spaced rows of horizontally extending tubes and end cap means for coupling adjacent ends of the tubes to form an upwardly progressing serpentine path for the exhaust gases;

a heating unit exhaust outlet heat exchanger which will collect creosote and prevent it from becoming deposited on the chimney, thereby reducing the likelihood of chimney or flue fires;

a heating unit exhaust outlet heat exchanger which can be more readily cleaned;

a heating unit exhaust outlet heat exchanger having a plurality of vertically spaced horizontally extending exhaust conveying tubes and shroud means for housing the tubes so that air at or near room temperature will flow by convection generally horizontally past a relatively large proportion of the tubes;

a heating unit exhaust outlet heat exchanger having a plurality of vertically spaced rows of horizontally extending exhaust conveying tubes and shroud means for directing room air past separately housed vertically spaced clusters of the tubes so that the higher tubes will not come into contact with air already heated by the tubes therebelow;

a heat exchanger for coupling the exhaust outlet of a room heating unit to a chimney so that heat can be more efficiently extracted from the exhaust gases flowing therethrough including a plurality of vertically spaced rows of horizontally extending exhaust conveying tubes and easily removable end cap means for connecting adjacent ends of the tubes in an airtight manner to define a serpentine exhaust gas path; and a heat exchanger of the aforementioned type having shroud means for directing air flowing by convection past separately housed vertically spaced clusters of the tubes and for separately directing air flowing by convection past the end cap means.

The present invention provides a heat exchanger for coupling the exhaust outlet of a room heating unit to a chimney so that heat can be more efficiently extracted from the exhaust gases flowing therethrough without requiring the use of a fan. The heat exchanger has conduit means for coupling the exhaust outlet to the chimney which includes a plurality of vertically spaced rows of horizontally extending tubes and end cap means for coupling adjacent ends of the tubes to form an upwardly progressing serpentine path for the exhaust gases. The exchanger further has shroud means for directing air past the conduit means. The shroud means includes a plurality of open-ended compartments for separately housing vertically spaced clusters of the tubes. A plurality of vertically extending ducts each communicate with an open end of one of the compartments and air flows by convection generally horizontally past the tubes and upwardly through the ducts. The shroud means may further include secondary compartments for housing the end cap means and secondary ducts which communicate with the upper ends of the secondary compartments. Air flows by convection past the end cap means to extract heat therefrom.

BRIEF DESCRIPTION OF THE DRAWINGS

Further objects and advantages of the present invention will become apparent from the following description of a preferred embodiment of the invention, taken in conjunction with the accompanying drawings in which:

FIG. 4 is a front perspective view of the heat exchanger of FIG. 1 with the shroud means removed showing the construction of the horizontally extending exhaust conveying tubes and the end cap means which couple adjacent ends thereof to form an upwardly progressing serpentine path for the exhaust gases;

FIG. 5 is a rear perspective view of the heat exchanger of FIG. 4; and

DESCRIPTION OF THE PREFERRED EMBODIMENT

Figure 1:
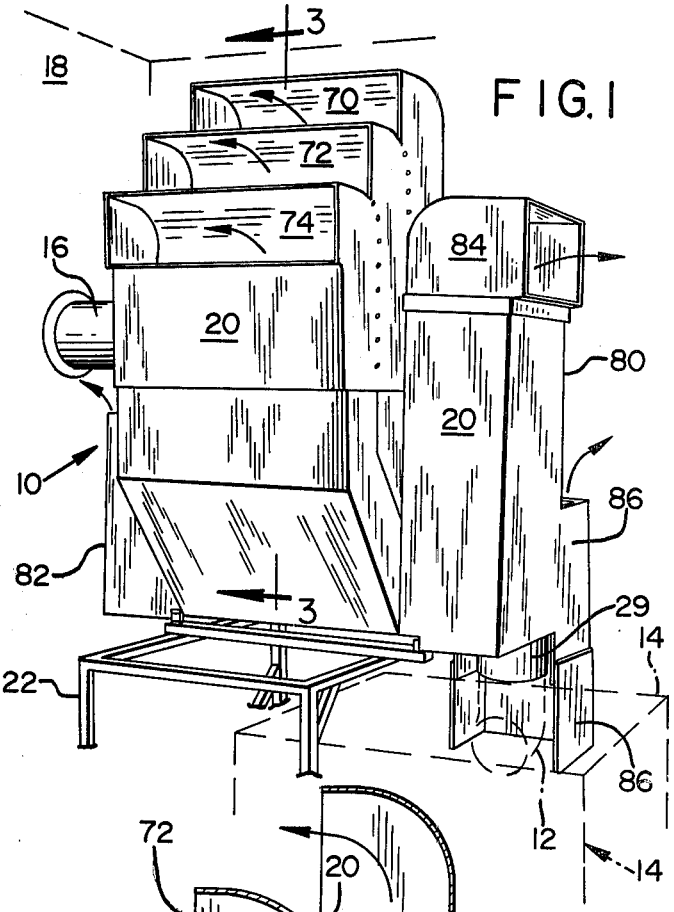
FIG. 1 is a front perspective view of the fully assembled heat exchanger which couples the exhaust outlet of a room heating unit shown in phantom lines with a chimney pipe shown on the left side of the figure.

Referring to FIG. 1, the illustrated embodiment of the heat exchanger 10 couples the exhaust outlet 12 of a stove 14 (shown in phantom lines) to a chimney 16 extending through a wall 18 of a room. The heat exchanger 10 includes shroud means generally designated 20 through which air flows by convection past the heated internal elements of the heat exchanger so that warmed air can be returned into the room as indicated by the arrows. The heat exchanger 10 is supported by its connections to the exhaust outlet 12 and the chimney 16 and by support frame 22 which straddles the stove 14.

Referring to FIG. 4, the heat exchanger 10 includes conduit means generally designated 24 for conveying high temperature exhausts from the exhaust outlet 12 to the chimney 16. The exhaust gases of a home stove or furnace typically reach temperatures of 450° F. or higher. The hot exhaust gases are conveyed through a plurality of vertically spaced rows of horizontally extending tubes 26 preferably made of sixteen gauge steel.

Figure 3:
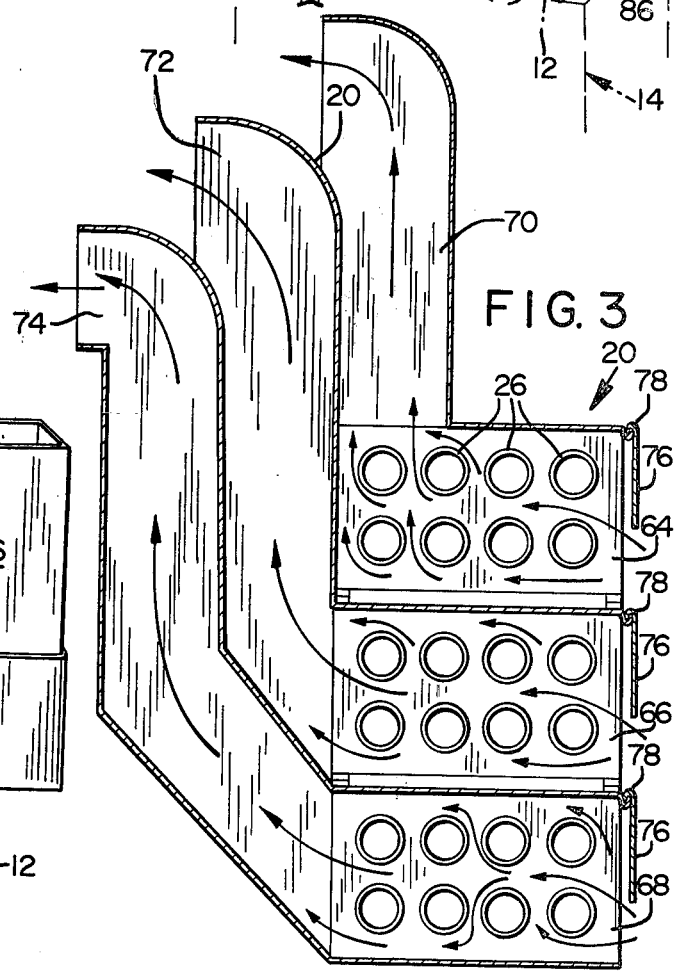
FIG. 3 is a vertical sectional view of the heat exchanger of FIG. 1 taken along line 3—3 of FIG. 1.

End cap means 28 are provided for coupling the tubes 26 to the exhaust outlet 12 and the chimney 16 and for coupling adjacent ends of the tubes to form an upwardly progressing serpentine path for the hot exhaust gases as illustrated by the arrows in FIGS. 4 and 5. As shown in FIG. 3, the exhaust conveying tubes 26 are arranged in separately housed clusters, each cluster consisting of two rows of tubes, each row having four tubes. Air flows by convection through the shroud means 20 as indicated by the arrows past the heated tubes 26 and back into the room.

The flow of air past the tubes 26 is generally transverse to the flow of exhaust gases through the tubes. The serpentine path for the exhaust gases enables a maximum length of tubing to be incorporated into the heat exchanger. An objective is to maximize the amount of contact between the ambient room air drawn into the heat exchanger and the heated tubes 26.

Referring again to FIGS. 4 and 5, the end cap means **28*a* connects one set of ends of the lowest cluster of the tubes 26 to an extension pipe 29 fitted over the exhaust outlet 12. The end cap means 28*b* connects one set of ends of the highest cluster of the tubes 26 to the chimney 16. The end cap means 28*a* and 28*b*** function as ninety degree elbows.

The end cap means **28*c* and 28*d* function as double elbows. They connect the ends of one cluster of the tubes 26 to the adjacent ends of an adjacent cluster of the tubes. The end cap means 28*a–d* provide not only structural support for the tubes 26** but also the means by which exhaust gases are conveyed into and out of the tubes.

Figure 6:
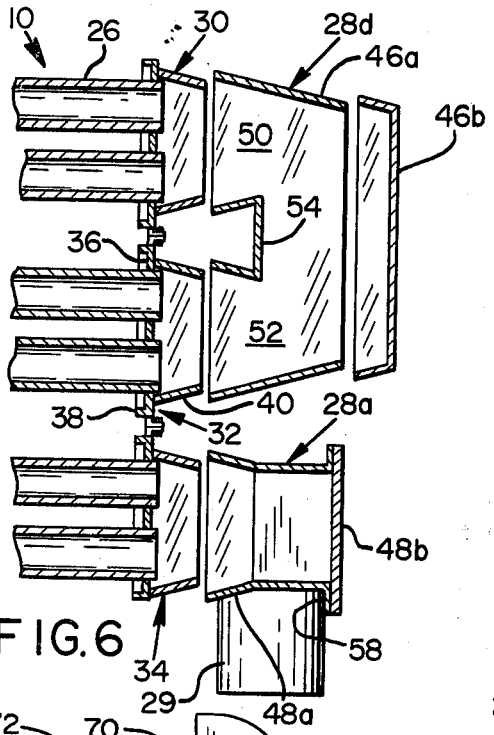
FIG. 6 is a fragmentary vertical sectional view, partially exploded, taken along line 6—6 of FIG. 4.

FIG. 6 illustrates the structural details of the end cap means **28*a* and 28*d*. They are the same for the end cap means 28*b* and 28*c*, respectively. The tubes 26 are rigidly secured at their one ends in three cowl structures 30, 32 and 34. Each cowl structure such as 32 includes a rectangular mounting plate 36 (FIGS. 5 and 6) having a flange 38 surrounding its perimeter. The plate 36 has a plurality of holes therethrough for receiving the ends of the tubes 26 which are rigidly welded or soldered to the plate. The cowl structure 32 further includes a rectangular tapered portion 40 (FIG. 6) formed by four converging walls. As best shown in FIG. 4, the cowl structures 30, 32, and 34 and the corresponding cowl structures at the other ends of the tubes 26 are secured one to another by bolt assemblies 42 secured through abutting ears or tabs 44** welded to the cowl structures.

The end cap means **28*a–d* further include tapered cover members adapted to conformably fit over and seal the cowl structures to form gas conveying conduits. Referring to FIG. 6, the cover members are of two basic types. The first type consists of two parts 46*a* and 46*b* which fit over the cowl structures 30 and 32 to form a double elbow. The second type of cover member consists of two parts 48*a* and 48*b* which fit over the cowl structure 34 to form a part of the ninety degree elbow that connects the heat exchanger 10 to the extension pipe 29**.

As shown in FIG. 6, the cover member part **46*a* has two separate tapered portions 50 and 52 adapted to fit over the tapered cowl structures 30 and 32, respectively. The portions 50 and 52 are joined by a plate 54. When the tapered cover member part 46*b* is fit over the outer end of the cover member part 46*a* a double elbow is formed so that hot exhaust gases can travel from the intermediate cluster of tubes 26 to the uppermost cluster of tubes. As shown in FIGS. 4 and 5 the cover member 46***a* has tabs such as 56 and bolt assemblies extend through the respective cowl structures and through the tabs 56 to tightly secure the same together.

Referring again to FIG. 6, the cover member part 48*a* is tapered and conformably fits over the lowermost cowl structure 34. The outer end of the cover member part 48*a* has a flange 58 against which is held the cover member part 48*b*. As shown in FIGS. 4 and 5, the end cap means 28*a* has a generally triangular horizontal cross section. The cover member part 48*b* angles toward the tubes 26 from the extension pipe 29 so that hot exhaust gases rising upwardly from the exhaust outlet 12 are guided into the ends of the lowermost cluster of tubes 26 as indicated by the arrows in FIG. 5. The rearward end of the chamber defined by the cowl structure 34 and the cover member parts 48*a* and 48*b* is coupled to a right angle hood 60 which is in turn connected to the extension pipe 29. The cover member part 48*a* is tightly held over the cowl structure 34 by bolt assemblies which extend through tabs 62 (FIG. 4) extending from the cover member part 48*a* and through the plate 64 of the cowl structure 34.

The tapered interfitting parts of the end cap means enable an airtight seal to be readily obtained merely by tightening the bolt assemblies which hold them together. The outermost cover members are easily removed so that an auger or other cleaning tool can be worked down the interiors of each of the tubes 26 to remove creosote, soot, etc. which is deposited on the interior walls thereof. Because of the relatively great length of tubing which the heat exchanger incorporates a large proportion of the creosote is deposited on the interior walls of the tubes 26 instead of on the walls of the chimney 16. This is desirable since the tubes can be readily cleaned on a periodic basis. The incidence of chimney or flue fires is substantially reduced in comparison to the standard arrangement where the exhaust outlet 12 is directly coupled to the chimney 16.

It is important to periodically remove the creosote and soot from the tubes 26 not only to reduce the incidence of flue fires, but also to prevent a drop in heat exchange efficiency. Deposited creosote and soot have a tendency to form a thermal insulating layer which inhibits the transmission of heat from the hot exhaust gases to the steel tubes 26. Periodic cleaning is necessary in order to insure that a maximum amount of the heat contained in the exhaust gases is transferred to the steel tubes 26 and to the air which circulates therepast. The design of the present heat exchanger permits easy straight-in access into each of the tubes 26 from either of their ends.

The shroud means 20 of the present invention includes means for separately housing three clusters of the tubes 26 so that air will flow by convection past the same. Referring to FIG. 1, the shroud means 20 is preferably formed from light gauge sheet steel which may be cut and formed into the configuration shown and held together by suitable means such as screws, rivets, solder, etc. Three separate generally rectangular compartments 64, 66 and 68 (FIG. 3) are provided for separately housing the three clusters of tubes 26. Each compartment has a pair of open ends through which air can flow as indicated by the arrows.

Communicating with the open ends of the compartments 64, 66 and 68 are vertically extending ducts 70, 72 and 74. The upper portions of the three ducts are configured to direct the flow of warm air generally horizontally into the room as shown. When the tubes 26 reach their operating temperatures air is drawn through the compartments 64, 66 and 68 and is expelled through the ducts 70, 72 and 74 as a result of convection, the ambient room air being heated by the tubes 26 as it circulates past the same.

Maximum heat exchange efficiency is achieved since a larger proportion of the exhaust conveying tubes are contacted by air at or near room temperature than in previous designs. This is because clusters of the vertically spaced tubes are separately housed and air already heated by the lower tubes cannot flow upwardly into contact with the upper tubes. Instead the air flows generally horizontally past the tubes 26 as indicated by the arrows in FIG. 3. Better heat transfer results if the temperature difference between the tubes 26 and the air which initially circulates therepast is relatively great.

Flap means in the form of panels 76 cover roughly the upper halves of the intake openings of the compartments 64, 66 and 68 to insure that room air is directed around the lower tubes 26 of each of the clusters. The upper peripheries of the panels 76 and the outer edges of the upper walls of the compartments are bent to form interengaging hook assemblies 78 which permit the panels 76 to be readily removed if desired.

Figure 2:
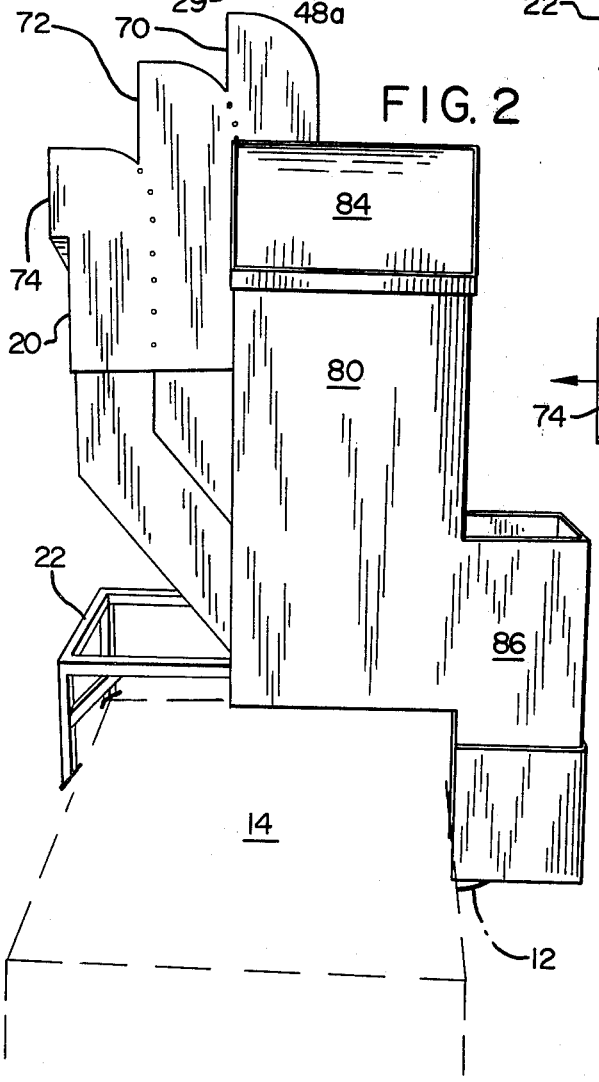
FIG. 2 is a perspective view of the side of the heat exchanger of FIG. 1 opposite from the chimney pipe.

Referring to FIGS. 1 and 2, generally rectangular secondary compartments 80 and 82 separately house the end cap means 28*a–d*. These compartments have open upper and lower ends and air flows by convection upwardly through the compartments to extract heat from the hot end cap means. The upper end of the compartment 80 is provided with a right angle duct 84 which directs air into the room at a ninety degree angle from the ducts 72 and 74. The air rising through the secondary compartments does not contact the air passing through the compartments 64, 66 and 68 which house the tubes 26. The secondary compartments 80 and 82 are preferably constructed and mounted so that they can easily be removed to permit removal of the end cap means 28*a–d* and cleaning of the tubes 26.

Finally, the shroud means 20 also includes a generally rectangular compartment 86 (FIGS. 1 and 2) which separately houses the exhaust outlet 12 and the extension pipe 29. The compartment 86 has open upper and lower ends. Air flows by convection upwardly through the compartment 86 as shown by the arrow in FIG. 1 to extract heat from the exhaust outlet 12 and the extention pipe 29.

The superior efficiency of the heat exchanger described above has been confirmed by test usage of a prototype in conjunction with a wood burning stove. With the stove fully stoked it was possible for me to grasp the chimney 16 and hold the same without burning my hand. The flow of warm air from the duct 74 was sufficient to extinguish a lighted candle held close to its output opening. A further advantage was observed in that the extraction of heat reduced the draft and thereby prevented the wood in the stove from being consumed too rapidly.

While a preferred embodiment of the present invention has been illustrated and described in detail it should be apparent that the invention permits of modification in both arrangement and detail. For example, the number of compartments and the number and spacial relationship of the exhaust conveying tubes within the compartments can be varied. The configuration of the ducts may be varied. I claim as my invention all such modifications as come within the true spirit and scope of the following claims.

I claim:

1. A heat exchanger for coupling the exhaust outlet of a heating unit to a chimney and extracting heat from the exhaust gases flowing therethrough, comprising:

conduit means for coupling the exhaust outlet to the chimney including a plurality of vertically spaced rows of horizontally extending tubes and end cap means for coupling adjacent ends of the tubes to form an upwardly progressing serpentine path for the exhaust gases; and shroud means for directing air past the conduit means including means for separately housing a plurality of vertically spaced clusters of the tubes so that air will flow by convection generally horizontally past the tubes, the shroud means further including means for separately housing the end cap means so that air will flow by convection past the end cap means.

2. The heat exchanger of claim 1 wherein the means for housing the tubes includes a plurality of generally rectangular compartments, each compartment housing one of the clusters of tubes and having a pair of open ends, and a plurality of vertically extending ducts each communicating with an open end of one of the compartments.

3. The heat exchanger of claim 2 wherein the means for housing the end cap means includes a duct.

4. The heat exchanger of claim 1 wherein the conduit means includes three clusters of tubes, each cluster made of two rows of tubes.

5. A heat exchanger for coupling the exhaust outlet of a heating unit to a chimney and extracting heat from the exhaust gases flowing therethrough, comprising:

conduit means for coupling the exhaust outlet to the chimney including a plurality of vertically spaced rows of horizontally extending tubes and end cap means for coupling adjacent ends of the tubes to form an upwardly progressing serpentine path for the exhaust gases; and shroud means for directing air past the conduit means including means for separately housing a plurality of vertically spaced clusters of the tubes so that air will flow by convection generally horizontally past the tubes, said means for housing the tubes including a plurality of generally rectangular compartments, each compartment housing one of the clusters of tubes and having a pair of open ends, and a plurality of vertically extending ducts each communicating with an open end of one of the compartments, each compartment being provided with flap means at its open end opposite from the duct communicating therewith for directing air toward the lower portion of the compartment.

6. A heat exchanger for coupling the exhaust outlet of a heating unit to a chimney and extracting heat from the exhaust gases flowing therethrough, comprising:

conduit means for coupling the exhaust outlet to the chimney including a plurality of vertically spaced rows of horizontally extending tubes and end cap means for coupling adjacent ends of the tubes to form an upwardly progressing serpentine path for the exhaust gases; and shroud means for directing air past the conduit means including means for separately housing a plurality of vertically spaced clusters of the tubes so that air will flow by convection generally horizontally past the tubes, said end cap means including a plurality of tapered cowl structures for enclosing the adjacent ends of the tubes, a plurality of tapered cover members adapted to conformably fit over and seal the cowl structures, and means for removably tightening each of the cover members over a corresponding one of the cowl structures.

7. A heat exchanger for coupling the exhaust outlet of a heating unit to a chimney and extracting heat from the exhaust gases flowing therethrough, comprising:

conduit means for coupling the exhaust outlet to the chimney including a plurality of vertically spaced rows of horizontally extending tubes and end cap means for coupling adjacent ends of the tubes to form an upwardly progressing serpentine path for the exhaust gases; and shroud means for directing air past the conduit means including first means for separately housing a plurality of vertically spaced clusters of the tubes so that air will flow by convection generally horizontally past the tubes and second means for separately housing at least a portion of the end cap means so that air will flow by convection past the same.

8. The heat exchanger of claim 7 wherein the first housing means includes a plurality of generally rectangular compartments, each compartment housing one of the clusters of tubes and having a pair of open ends, and a plurality of vertically extending ducts each communicating with an open end of one of the compartments.

9. The heat exchanger of claim 7 wherein the second housing means includes a duct.

10. The heat exchanger of claim 7 wherein the conduit means includes three clusters of tubes, each cluster made of two rows of tubes.

11. The heat exchanger of claim 8 wherein each compartment is provided with flap means at its open end opposite from the duct communicating therewith for directing air toward the lower portion of the compartment.

12. The heat exchanger of claim 7 wherein the end cap means includes a plurality of tapered cowl structures for enclosing the ends of adjacent ones of the tubes, a plurality of tapered covered members each adapted to conformably fit over and seal a cowl structure, and means for removably tightening each of the cover members over a corresponding one of the cowl structures.

13. A heat exchanger for coupling the exhaust outlet of a heating unit to a chimney and extracting heat from the exhaust gases flowing therethrough, comprising:

conduit means for coupling the exhaust outlet to the chimney including a plurality of vertically spaced rows of horizontally extending tubes and end cap means for coupling adjacent ends of the tubes to form an upwardly progressing serpentine path for the exhaust gases, the tubes being arranged in three clusters, each cluster made of two rows of tubes, the end cap means including a plurality of tapered cowl structures for enclosing adjacent ends of the tubes, a plurality of tapered cover members each adapted to conformably fit over and seal a cowl structure, and means for removably tightening each of the cover members over a corresponding one of the cowl structures; and shroud means for directing air past the conduit means including, a plurality of generally rectangular first compartments, each first compartment housing one of the clusters of tubes and having a pair of open ends, at least one secondary compartment for separately housing at least a portion of the end cap means, the secondary compartment having a pair of open ends, and a plurality of ducts, each duct communicating with the open end of a compartment, whereby air will flow by convection generally horizontally past the tubes to extract heat therefrom and air will also flow past the portion of the end cap means for extracting heat therefrom.

* * * * *